US005930971A

United States Patent [19]

Etheridge

[11] Patent Number: 5,930,971

[45] Date of Patent: Aug. 3, 1999

[54] BUILDING CONSTRUCTION WITH TENSIONED SUPPORT SYSTEM

[76] Inventor: Diana C. Etheridge, 6007 N. Tropical Trail, Merritt Island, Fla. 32953

[21] Appl. No.: 09/124,041

[22] Filed: Jul. 29, 1998

[51] Int. Cl.[6] ..... E04H 12/18

[52] U.S. Cl. ..... 52/646; 52/651.11; 52/653.2; 52/655.1; 52/222; 52/63; 135/122; 135/123; 135/127; 135/128; 135/135; 135/136; 135/901; 135/902; 135/908

[58] Field of Search ..... 52/646, 648.1, 52/651.11, 653.1, 653.2, 655.1, 222, 223.1, 227.11, 223.14, 223.6, 63; 135/121, 123, 122, 124, 125, 127, 128, 901, 902, 908, 114, 115, 135, 136

[56] References Cited

U.S. PATENT DOCUMENTS 4,076,431 2/1978 Burvall .
4,450,656 5/1984 Lagendijk .

*Primary Examiner*—Christopher T. Kent
*Assistant Examiner*—Yvonne Horton-Richardson
*Attorney, Agent, or Firm*—Dennison, Meserole, Scheiner & Schultz

[57] ABSTRACT

A structural system for a building wherein multiple elongate rigid structural members, in the nature of posts and beams, include internal tensioning cables which, upon an end joining of the structural members, are interlocked and tensioned to each other and relative to a fixed foundation.

13 Claims, 5 Drawing Sheets

FIG. 4
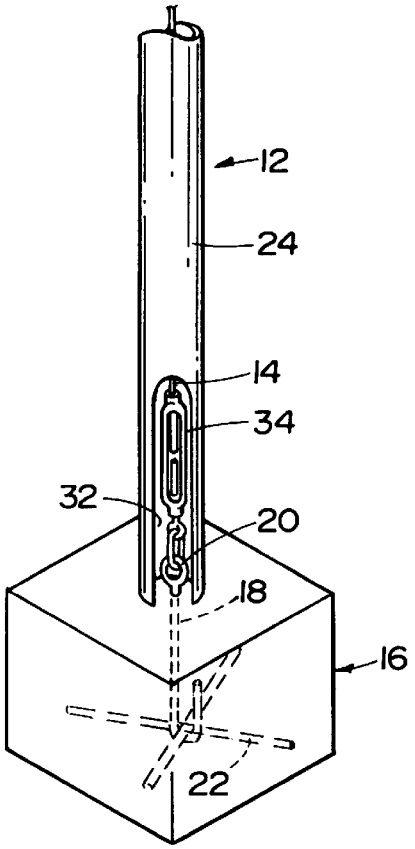
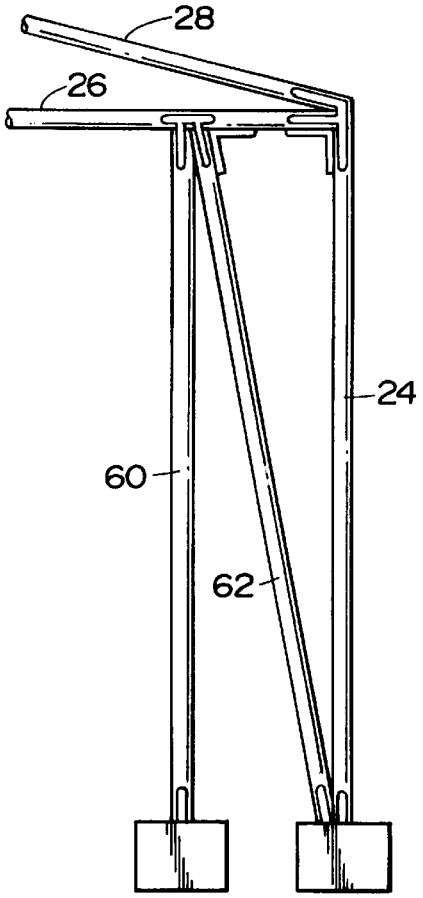
FIG. 5
FIG. 6
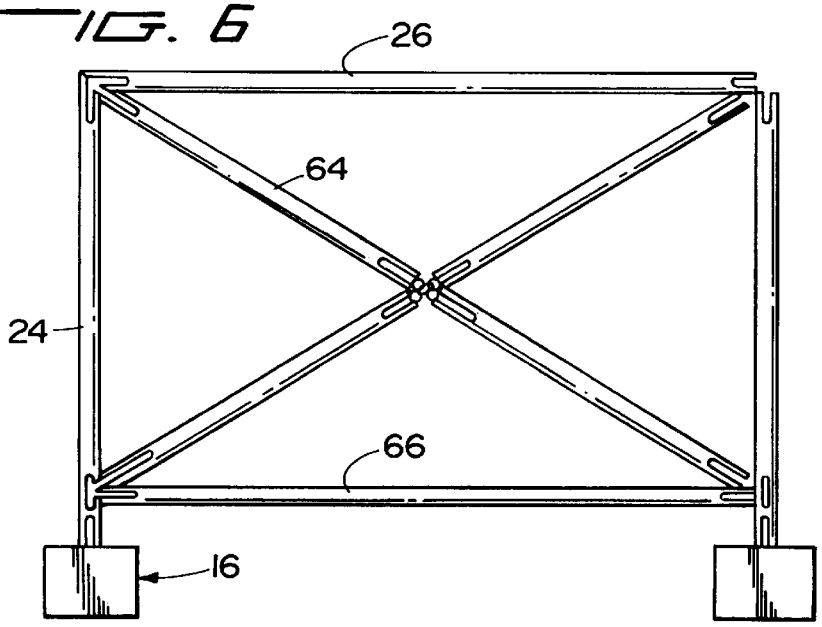

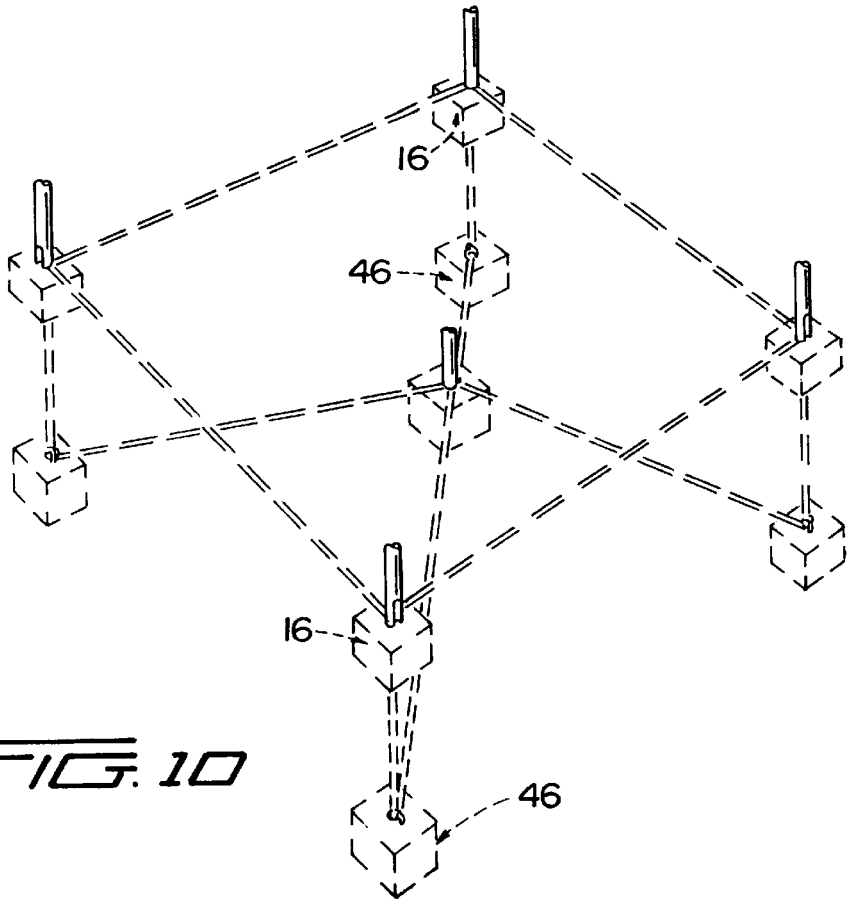
FIG. 10
FIG. 9
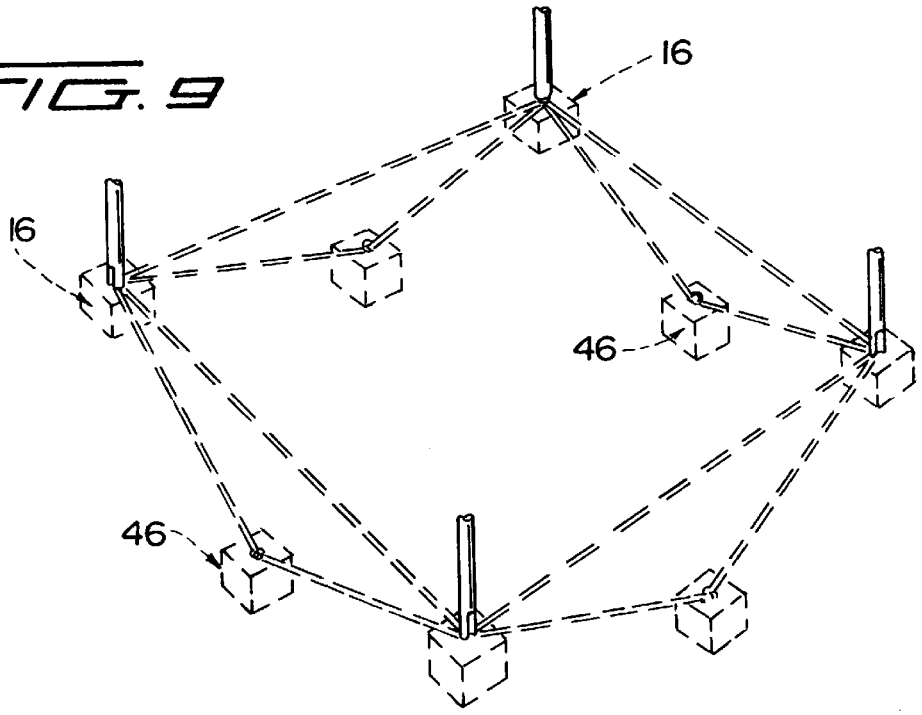

BUILDING CONSTRUCTION WITH TENSIONED SUPPORT SYSTEM

BACKGROUND OF THE INVENTION

Having appropriate shelter is an essential requirement for all the peoples of the world, regardless of environmental, climatic or economic conditions. However, the problems involved in the provision of appropriate shelter are particularly acute in remote areas wherein access is limited, where there is little building material available and where it would be prohibitively expensive to import conventional construction materials. Similar problems arise in areas wherein the economic resources of the inhabitants do not allow for the construction of buildings which might be considered a permanent home with the attributes preferably associated therewith, including structural stability, an acceptable appearance, a secure interior and other such universal requirements.

SUMMARY OF THE INVENTION

It is a principal object of the present invention to provide an inexpensive structural system which allows for the construction of conventionally appearing buildings both rapidly and without the necessity for skilled labor. The basic structural system uses lightweight and readily transportable material, and in fact may use any naturally occurring materials at the site of construction. This allows for use of the basic system of the invention in even the most remote and/or economically disadvantaged areas.

While the structural system of the invention is intended principally to provide buildings which in both appearance and function approximate conventional constructed buildings, the building structures of the invention can in fact be used as temporary shelters. This is quite feasible in view of the lightweight and highly portable nature of the basic structural materials, the ease of assembly and disassembly, the convenience of storage of the structural components, and the like.

Basically, the construction system utilizes a plurality of rigid, compression-accommodating structural members, preferably tubular, defining upright support posts, roof beams, cross beams, and the like. The rigid structural members are stabilized by elongate tension members, generically herein referred to as cables, received through each of the structural members and end joined, upon a proper tensioning thereof, at or immediately adjacent the adjoining ends of the structural members. The joined cables ultimately extend through uprights and are in turn anchored to an underlying foundation either in the nature of a solid cast concrete slab with anchoring loops extending therefrom, or individually cast footings associated with each upright.

In an assembly of the basic structural components of the building, the footings or foundation slab, either poured in situ or preformed, are positioned to define the parameters of the building. Next, the upright, rigid structural members or posts, with tension cables running therethrough and anchored to the foundation, are positioned and, utilizing appropriate couplers or brackets, joined to roof beams, ceiling beams, floor beams and such other supports or cross braces as desired. Each of the structural members has a tension cable positioned therein with the brackets and/or the adjacent end portions of the various members having openings allowing for ready access to the ends of the tension cables in ends of the members. Appropriate tensioning means such as turnbuckles, cable winch pullers and like implements, at the juncture of the structural members, will be used between the cable ends to provide the desired cable tension. The tensioned cables in turn lock, through the resultant compression, the various structural members together into a stable structure which, depending upon environmental conditions, can be completely rigid or capable of a degree of flexible movement as when subjected to high winds.

The completion of the building can, in its simplest form, involve the mounting of flexible nylon sheets with appropriate window and door openings defined therein, and, in the other extreme, include the provision of rigid insulated panels with coatings of stucco or the like to provide substantial additional strength and the appearance of a conventionally constructed building.

Other features and advantages of the invention will become apparent from the following more detailed description of the invention.

BRIEF DESCRIPTION OF THE DRAWINGS

FIG. 4 is a detailed illustration of an anchoring footing with a post mounted thereto;

FIG. 5 is a schematic illustration of the utilization of the components in forming a braced and/or hollow wall construction;

FIG. 6 is a schematic illustration of a side wall with wall braces;

FIGS. 9 and 10 schematically illustrate variations in the foundation layouts

DESCRIPTION OF PREFERRED EMBODIMENTS

Figure 1:
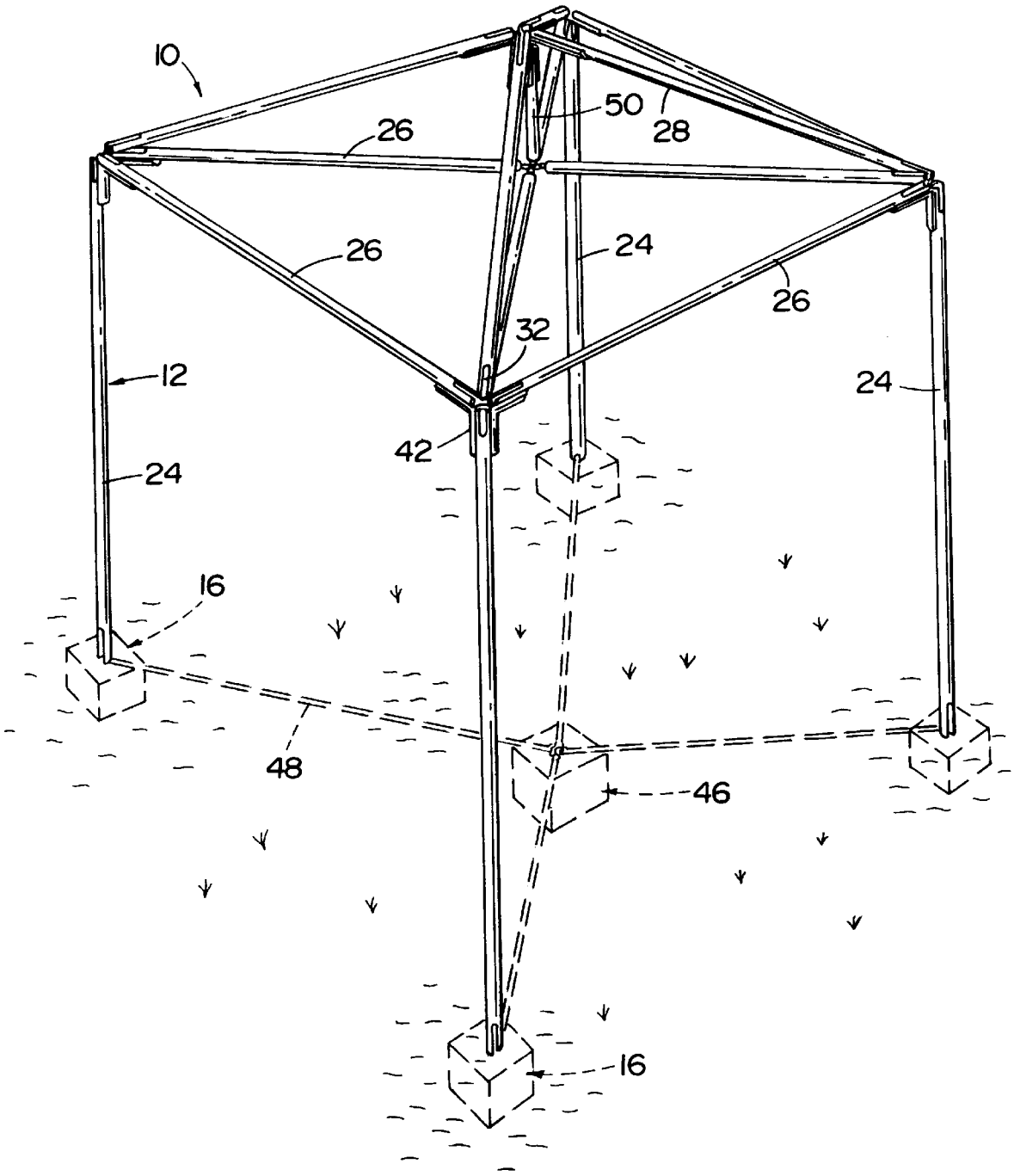
FIG. 1 is a perspective and generally schematic view of the structural components assembled to define a basic building in accord with the present invention.

Referring now more specifically to the drawings, FIG. 1 illustrates a structural system in accord with the present invention utilized to define a basic building 10. The structural system essentially comprises elongate rigid, compression-accommodating structural members 12 and elongate flexible tension members, generically referred to as cables 14.

Figure 3:
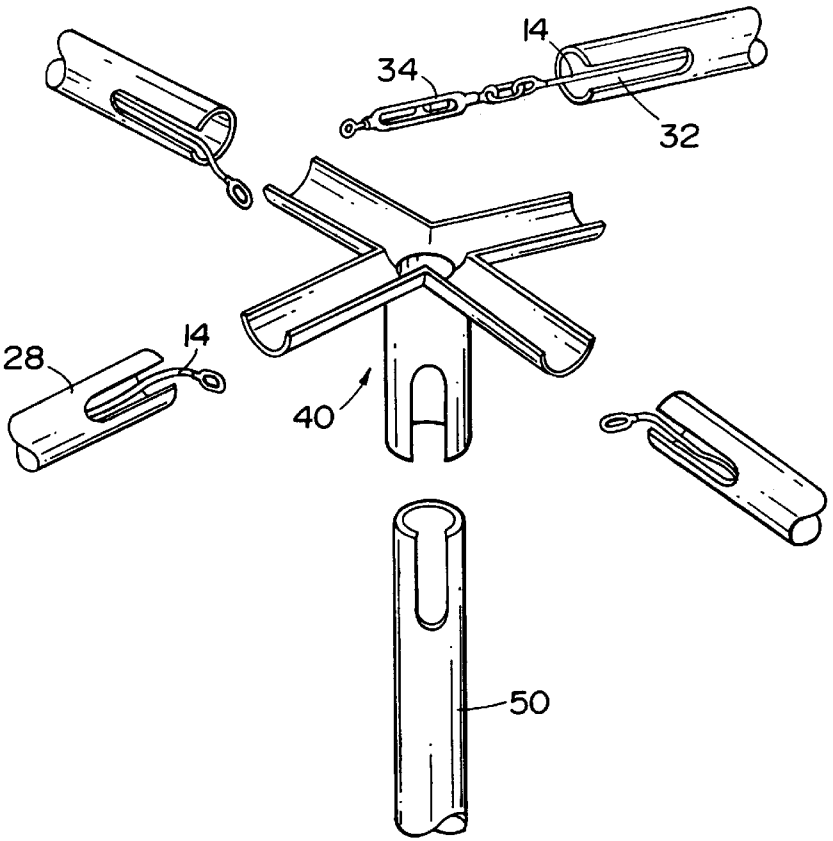
FIG. 3 is an enlarged perspective detail illustrating a typical relationship between various components at an upper roof peak.
Figure 2:
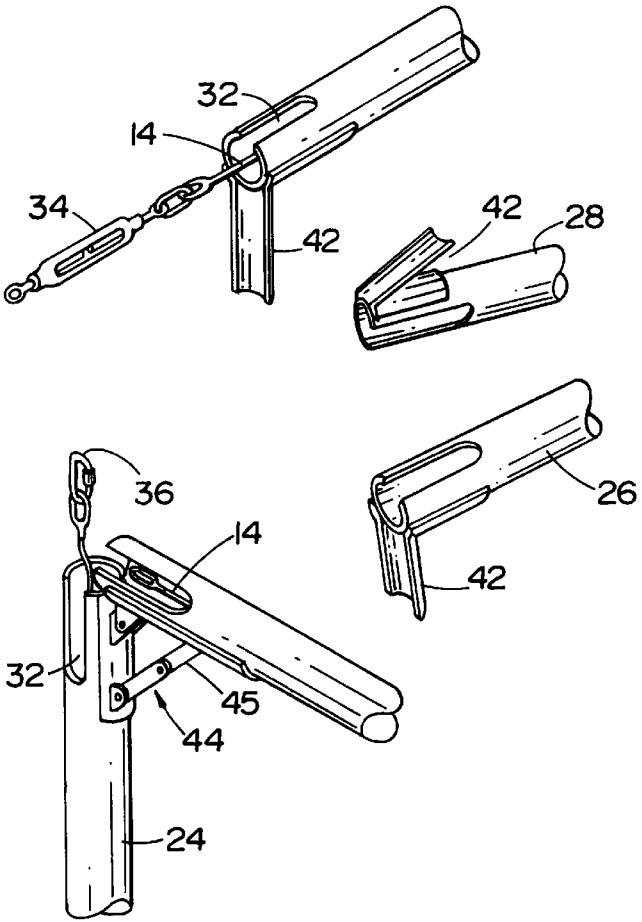
FIG. 2 is an enlarged perspective detail illustrating a typical relationship between various components at an upper building corner.

The members 12 define full length channels along which the cables 14 extend, and are preferably in the form of hollow cylindrical or rectangular pipes of any appropriate material including aluminum, steel, synthetic resinous materials and the like, as best seen in FIGS. 2 and 3. As desired, the synthetic resinous members, for example of fiberglass or PVC, can be appropriately reinforced to achieve the desired strength.

The tension members or cables 14 can similarly be of a variety of materials, including link chains, wire rope, woven grass rope (assuming remote tropical or semi-tropical locations) and such other materials as will provide the desired flexibility and tensile strength.

In erecting or assembling a building 10 in accord with the invention, an appropriate foundation is provided. This foundation can be in the nature of a single slab formed in situ or, preferably, can comprise a series of foundation or anchor blocks 16. Each foundation block 16 can be of a rectilinear or cylindrical configuration internally reinforced and having an anchor 18 imbedded therein and exposed centrally upward therefrom, terminating in an appropriate cable-engaging end, preferably a loop or hook 20 (FIG. 4). As one manner of securing the anchor within the block 16, the lower end of the anchor can be reversely turned into a hook configuration and engaged with and beneath crossing reinforcing bars 22.

The elongate rigid structural members 12 are the support elements of the building and include upright or post members 24 positioned at the corners of the building 10 and at such intermediate points whereat additional support is deemed desirable, as in a building of substantial length. A foundation block 16 underlies each of the support posts 24 with the projecting anchor 18 aligned with the cable-receiving channel within the post.

The members 12 also form both ceiling beams 26 extending generally horizontally between the upper ends of the posts 24, and roof beams or rafters 28 which, as illustrated, may extend upwardly from the upper ends of the support posts 24 to a central peak.

An appropriate tension cable 14 will be provided within each of the structural members 12 with the opposed ends of each cable exposed for joinder to the adjacent end or ends of cables 14 associated with adjoining members 12. In order to provide for this accessibility to the cable ends, the opposed ends of the structural members can have longitudinally extending openings 32 wherein the cable end portions are exposed. Such openings are to be of a size as to receive an appropriate cable tensioning mechanism which may be as elaborate as a removable cable winch puller (not illustrated), or as simple as a turnbuckle 34. As the cables are tensioned, the corresponding structural members, including the posts and beams, are in effect compressed end-to-end into a rigid structural system with, as desired for high wind accommodation and the like, a degree of flexibility determined by the tension within the cables. Depending upon the nature of the cables, and the tensioning mechanism, the adjoining ends of the cables, upon a tensioning thereof, are interlocked by appropriate connectors 36 in the manner of links, double "s" hooks, locking rings and the like, the strength of which is at least equal to the tensile strength of the cables. In the situation wherein turnbuckles are used, the turnbuckles themselves will act as the connectors.

Figure 7:
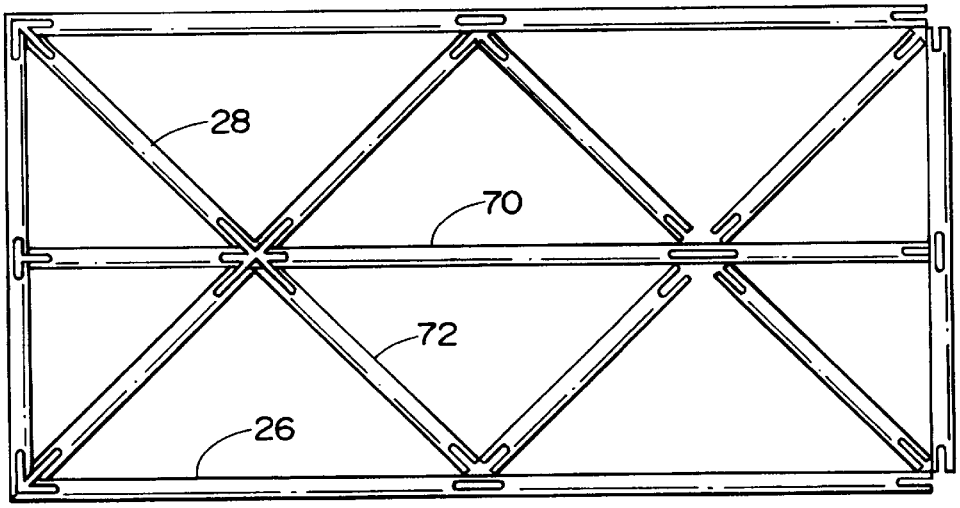
FIG. 7 is a schematic roof plan illustrating an expanded building with a ridge beam.

As schematically illustrated in FIG. 5, and on the left side of the structures of FIGS. 6 and 7, the ends of the structural members 12, including the posts 24 and beams 26 and 28, are preferably so formed as to provide contact or seating ends which engage and stabilize each other, with the access openings 32 allowing for the necessary communication between and access to the cables ends. As desired, and depending upon the material of the structural members, the abutting ends thereof, if necessary, can be shaped at the construction site. As another possibility, specifically shaped hollow abutment blocks can be provided at various member junctions.

As will be appreciated, the particular nature of the cables will determine the actual manner in which the joining and tensioning thereof is achieved. For example, with chain cables the tightening mechanism can engage selected ones of the chain links for a drawing together of the cables with the excess links either stored within the hollow structural members or removed. If the cables are in the nature of wire rope or the like, the ends of the cables, at the job site, can be formed into loops and appropriately provided with crimped collars to define engaging eyes for accommodation by the tensioning mechanism.

As will be best appreciated from FIGS. 1 and 4, the cable system itself is ultimately linked to the foundation or foundation blocks 16 by engagement of the cables associated with the support posts 24 with the loops or hooks 20 of the anchors 18 aligned with the posts. As desired, and with an appropriate access opening 32 provided at the base of each post 24, the cable system can be tensioned at these points after an appropriate joinder of the upper ends of the post cables to the various beam cables. Also, the post cables can first be joined to the anchors 18 with the upper ends of these post cables selectively engaged and tensioned with the cables of the various ceiling and roof beams positioned thereabove.

Referring now to the enlarged detail illustration of FIGS. 2 and 3, in order to further assist in properly relating, stabilizing and positioning the adjoining ends of the various rigid members 24, 26 and 28, relative to each other, couplers or coupling brackets are provided. The brackets can take several forms. For example, the bracket 40 illustrated in FIG. 3 at the roof peak is a preformed member with multiple arms each of a size so as to receive and support an end portion of one of the roof beams 28 thereon.

Several forms of rigid brackets 42 are illustrated in FIG. 2 between the adjoining end portions of the beams. These brackets 42 will usually include a pair of rigid angularly related arms which engage between the adjoining beams, or the beams and a post.

A third form of bracket 44 is illustrated between the upper end portion of one of the support posts 24 and the adjacent end portion of a ceiling beam 26. This bracket 44 is intended to allow for a degree of preassembly wherein adjoining end portions of the structural members are joined for a selective collapsing of the structural members relative to and in conjunction with each other. As such, the bracket 44 has the two arms thereof pivotally joined at their inner ends with each arm affixed to a corresponding structural member end portion and with a collapsible hinged brace 45 between the bracket arms. The brace 45 is of a standard construction, for example as used in bridge table legs, and allows for a collapsing of the bracket arms, and hence the structural members secured thereto and to a generally parallel folded relationship with each other. Similarly, the brace allows for an extension of the bracket arms to the desired full extent thereof, for example to a right angle relationship as illustrated, at which point the brace locks the bracket arms, and hence the structural members, in position until physically released.

In those instances wherein additional stability is required in the foundation of the structure beyond that provided by the post-aligned earth embedded foundation blocks 16, a stabilizing block or blocks 46 can be provided centrally located between the foundation blocks 16 or a selected number of these blocks 16 and more deeply embedded within the ground as suggested in FIG. 1. Additional tensioned cables 48 will extend between the stabilizing block or blocks 46 and the associated foundation blocks 16 and will be either directly or indirectly end joined to the post cables at the anchors 18 whereby tension developed in the post and beam cables can be distributed beyond the basic foundation blocks 16 for an enhanced stabilization of the structure. The cables 48 will preferably be protected against ambient conditions by an appropriate coating or in fact enclosure within tubular members similar to the post and beams.

As will be appreciated, the foundation system, including foundation blocks and stabilizing blocks as referred to above, can be varied and adapted to particular site and building conditions. Examples of different foundation systems will be noted in FIGS. 9 and 10.

With specific reference to FIG. 9, the perimeter foundation blocks 16 are stabilized by the provision of more deeply embedded stabilizing blocks 46 between each pair of foundation blocks about the periphery of the structure. A central stabilizing blocks can also of course be provided with such an arrangement, as can additional foundation blocks beneath any intermediate vertical support posts.

FIG. 10 is an example of a further arrangement wherein stabilizing blocks 46 are located in spaced relation below the foundation blocks with tension cables therebetween as desired. A central stabilizing block, as illustrated, can also be provided at equal depth with the foundation blocks with tension cables running from the central stabilizing block to the perimeter stabilizing blocks. The central stabilizing block, as desired, can also be used as a direct foundation block for a central roof support post. As a variation of the arrangement in FIG. 10, if the primary support of the building is to arise from the block supported central post, it may not be necessary to provide the illustrated tension cables between the perimeter foundation blocks and the stabilizing blocks vertically therebelow. As will be recognized, the invention contemplates all such arrangements of foundation and stabilizing blocks as may be considered by those skilled in the art.

With reference to FIGS. 1 and 3, the structural system has been illustrated as including an upstanding central roof support post 50 depending from the peak of the roof defined by the roof beams 28 and the central support bracket 40. A cable extending through this roof post 50 will, in the manner previously described with regard to the cable associated with the support posts 24 and beams 26 and 28, have the ends thereof tensioned in the same manner to the roof beam cables joined at the bracket 40 and to the ceiling beams joined to an appropriate ceiling beam bracket at the meeting inner ends of the ceiling beams 26. Thus, the inherent strength of the peak-joined roof beams is utilized to support the underlying ceiling beams. Such an interrelated ceiling and roof support system is an example of the versatility of the structural system of the invention.

It is also to be appreciated that the basic structural system described above is expandable to produce structures of substantially any size and rigidity to best accommodate a variety of uses, environmental conditions, and the like.

More particularly, and noting FIG. 5, additional footing-supported posts 60 can be provided in inwardly spaced relation to the previously described corner support posts 24 with one or more diagonally bracing support posts 62 therebetween. In each instance, the upper and lower ends of the posts 60 and 62 will engage against the overlying beams and underlying footings with the tension cables therein appropriately engaged and tensioned with the footing anchors and the cables within the overlying beams in the manner previously described. Such inner support posts 60 can also be used to provide thicker or hollow core walls with internal spaces for utility lines, insulation, and the like.

FIG. 6 schematically illustrates a further manner of reinforcing the basic building structure by both providing diagonal bracing 64 between the corner support posts 24 and providing floor beams 66. Depending upon the length and positioning of the wall bracing 64, appropriate intermediate brackets will be provided. In each instance, the braces 64 and floor beams 66 will include coaxial tension cables and will mount to the adjacent ends of associated posts and beams in the manner described.

FIG. 7 schematically illustrates a roof view of an expanded building utilizing the system of the invention. In such a building, an elongate ridge beam 70 can be provided, either as a single member or as multiple end joined lengths with the internal tension cables appropriately tensioned and with appropriate end and intermediate roof beams 72 supporting the ridge beam 70. The system of tensioned cables interlocking the ridge beam 70 and roof beams 72 will provide a stable construction. As may be necessitated by the extended length of the building of FIG. 7, center support poles can also be provided, such poles extending vertically between underlying foundation blocks and the central ridge beam 70 to which they are joined by appropriate tensioned and interlocked cables extending from the foundation blocks to the tension cables within the ridge beam 70.

As will be appreciated from the above, the basic structural unit of FIG. 1 can be expanded both transversely and lengthwise, utilizing the basic structural compression-accommodating members, and tension members, to any practical size utilizing simple assembly methods which enable construction under substantially any environmental conditions.

Figure 8:
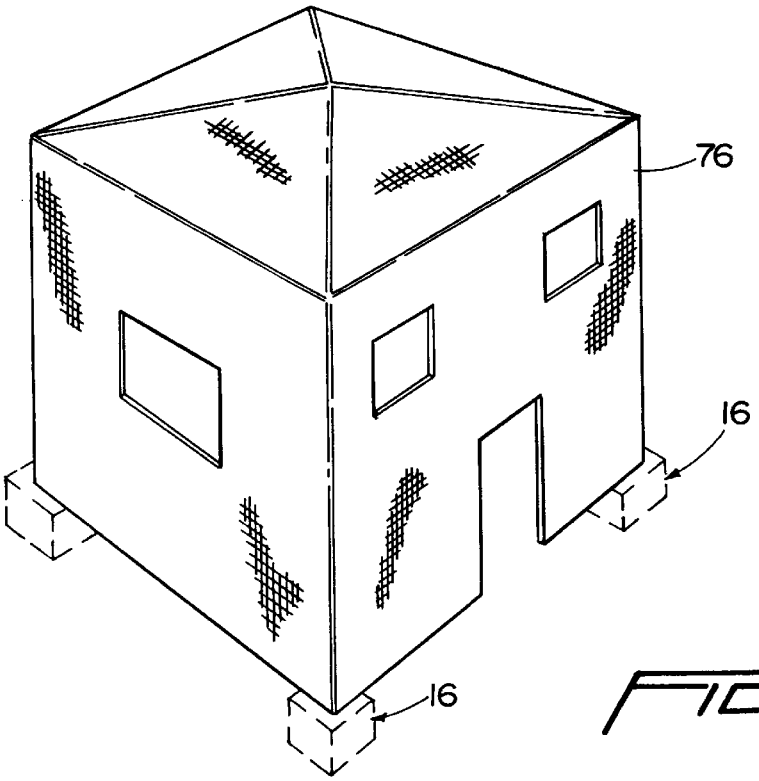
FIG. 8 is a schematic illustration of a building with a cover or enclosing walls and a roof.

As suggested in the schematic illustration of FIG. 8, it is contemplated that various means 76 be provided to enclose the support systems described above. In a basic form, appropriate sheets of flexible material, for example nylon, can be secured in any appropriate manner to the tension locked structural members to define walls and roofs with appropriate access openings formed therein.

Depending upon environmental conditions, insulating material can be sprayed or otherwise applied to the sheets. Similarly, if available, preformed insulating sheets can be used. In each instance, the addition of such materials will tend to further rigidify the construction. In those instances wherein a double wall construction is used, as in FIG. 5, both the inner and outer walls can be provided with retaining sheets and the space therebetween insulated by any appropriate means from sophisticated blown pellet insulation to straw or natural fibrous materials native to the area in which the structure or structures are formed.

It is also to be appreciated that the interior of the structure can be partitioned into individual rooms by sheets or panels of nylon or the like suspended from overlying ceiling or roof beams and, as desired, anchored in any appropriate means to underlying floor beams. Such internal partitions can also be formed with or subsequently provided with access doors, passages and the like.

It is to be recognized that the versatility of the structural system of the invention lends itself to additional uses including the construction of multiple floor buildings, the expansion of existing conventionally constructed buildings, the provision of temporary enclosures, as for example for trailers when anticipating severe weather conditions, the permanent enclosure of existing buildings, trailers and/or manufactured homes for the preservation thereof, and like uses which will be recognized by those skilled in the art.

The nature of the components of the structural system and the manner of erecting the structural system allows for a ready dismantling of the construction for storage purposes and to allow for its use as a temporary shelter. Similarly, the compact nature of the disassembled components, consisting basically of support poles and beams, tension cables and connectors or brackets, allows for a compact storage of the components.

The foregoing is illustrative of the features of the invention and the advantages derived therefrom. As variations, different embodiments and other practical uses may occur to those skilled in the art, it is to be appreciated that the invention is only to be limited by the scope of the claims following hereinafter.

I claim:

1. A structural system for buildings comprising multiple rigid elongate structural members having opposed ends, and elongate flexible tension cables, one cable extending along and retained by each of said members, each of said tension cables being accessible at each end of the associated structural members, selected ones of said members defining upright support posts, selected others of said members defining support beams transversely of and between said posts, the opposed ends of each said support post comprising an upper end and a lower end, said support posts and support beams being selectively positionable in an adjoining end-to-end relationship in a building-defining orientation, the cables along each of said posts and beams having opposed cable end portions at the opposed ends of the posts and beams, means for obtaining access to adjoining cable end portions at adjoining post and beam ends, means for engaging said adjoining cable end portions and tensioning the cables in the posts and beams, means for interlocking the adjoining cable end portions of the tensioned cables, and foundation means for receiving said lower ends of said posts and for defining a base for seating the lower ends of said posts, said foundation means including an anchor aligned with each post lower end and the cable end portion thereat, and means for fixing the cable end portion at each post lower end to one of said anchors wherein said foundation means forms a force resistant base for the tensioning of cables relative thereto.

2. The structural system of claim 1 including bracket means for fixing and supporting adjoining end portions of end-to-end positioned posts and beams.

3. The structural system of claim 2 wherein said foundation means includes individual post support blocks, one alignable under each post and mounting one of said anchors, at least one stabilizing block positionable centrally relative to selected ones of said post support blocks, and tensionable cable means for tensioned engagement with and between said selected ones of said post support blocks and said at least one stabilizing block.

4. The structural system of claim 2 wherein said structural members are subjected to and resist compressive loading upon tensioning of said cables.

5. The system of claim 2 wherein said bracket means includes multiple arm brackets, with the arms of each of said multiple arm brackets being pivotally joined for a selective folding of the arms and the structural members engaged therewith, and collapsible brace means for selective fixing the position of the pivotally joined arms.

6. The structural system of claim 1 wherein said means for obtaining access to adjoining cable end portions comprises access openings defined in each post and beam immediately adjacent each of the opposed ends thereof.

7. The structural system of claim 6 wherein said structural members are subjected to and resist compressive loading upon tensioning of said cables.

8. The structural system of claim 1 wherein said structural members include inclined brace members extending between opposed others of said structural members with the opposed ends of said brace members engaged with said opposed others of said structural members.

9. The structural system of claim 1 wherein selected ones of said support beams extend from the upper ends of said support posts to a common peak between and above said upper ends and laterally brace said support posts relative to each other.

10. A structural system for buildings comprising multiple rigid elongate structural members having opposed ends, and elongate flexible tension cables, one cable extending along and retained by each of said members, each of said tension cables being accessible at each end of the associated structural member, selected ones of said members defining upright support posts, selected others of said members defining support beams transversely of and between said posts, the opposed ends of each said support post comprising an upper end and a lower end, said support posts and support beams being selectively positionable in an adjoining end-to-end relationship in a building-defining orientation, the cables along each of said posts and beams having opposed cable end portions at the opposed ends of the posts and beams, means for obtaining access to adjoining cable end portions at adjoining post and beam ends, means for engaging said adjoining cable end portions and tensioning the cables in the posts and beams, and means for interlocking the adjoining cable end portions of the tensioned cables, and foundation means for receiving said lower ends of said posts and defining a base for seating the lower ends of said posts, said foundation means including individual post support blocks alignable under at least selected ones of said posts and including anchor means for engagement of the selected ones of said posts with the corresponding support blocks, said foundation means further including at least one stabilizing block positioned centrally between at least two of said selected ones of said support blocks with tensionable cable means extending therebetween for tensioned engagement therebetween, and wherein said at least one stabilizing block includes a central block and multiple peripheral blocks, said cable means being engagable under tension between said central block and each of said peripheral blocks.

11. The structural systems of claim 10 wherein said central block is at approximately a depth equal to the depth of the support blocks and said peripheral stabilizing blocks are of a greater depth than said support blocks.

12. The structural system of claim 11 wherein each of said peripheral blocks is vertically aligned below a separate one of said support blocks.

13. The structural system of claim 12 including tensionable cable means extending between each of said peripheral blocks and the corresponding support block vertically thereabove.

* * * * *